US008514069B2

(12) United States Patent
Hadsall, Sr.

(10) Patent No.: US 8,514,069 B2
(45) Date of Patent: Aug. 20, 2013

(54) TRACKING PASSENGERS ON CRUISE SHIPS

(75) Inventor: Richard Alan Hadsall, Sr., Miramar, FL (US)

(73) Assignee: MTN Satellite Communications, Miramar, FL (US)

( * ) Notice: Subject to any disclaimer, the term of this patent is extended or adjusted under 35 U.S.C. 154(b) by 950 days.

(21) Appl. No.: 12/617,207

(22) Filed: Nov. 12, 2009

(65) Prior Publication Data

US 2011/0109434 A1 May 12, 2011

(51) Int. Cl.
*G08B 1/08* (2006.01)

(52) U.S. Cl.
USPC ..... 340/539.13; 340/572.1; 340/572.4; 340/527.7; 340/539.1; 340/539.11; 235/375; 235/385

(58) Field of Classification Search
USPC ..... 340/572.1, 572.4, 572.7, 539.1, 539.11, 340/539.13; 235/375, 385
See application file for complete search history.

(56) References Cited

U.S. PATENT DOCUMENTS

| | | | |
|---|---|---|---|
| 5,682,142 | A | 10/1997 | Loosmore et al. |
| 5,914,671 | A | 6/1999 | Tuttle |
| 6,127,917 | A | 10/2000 | Tuttle |
| 6,396,413 | B2 | 5/2002 | Hines et al. |
| 6,529,164 | B1 | 3/2003 | Carter |
| 6,804,578 | B1 | 10/2004 | Ghaffari |
| 6,900,762 | B2 | 5/2005 | Andrews et al. |
| 6,963,282 | B1 | 11/2005 | Yeates et al. |
| 7,123,149 | B2 | 10/2006 | Nowak et al. |
| 7,242,303 | B2 | 7/2007 | Patel et al. |
| 7,298,258 | B1 | 11/2007 | Hudgens et al. |
| 7,319,395 | B2 | 1/2008 | Puzio et al. |
| 7,333,002 | B2 | 2/2008 | Bixler et al. |
| 7,336,181 | B2 | 2/2008 | Nowak et al. |
| 7,339,479 | B2 | 3/2008 | Nishimura |
| 7,388,481 | B1 | 6/2008 | Cahn |
| 7,403,120 | B2 | 7/2008 | Duron et al. |
| 7,443,306 | B2 | 10/2008 | Randall et al. |
| 7,477,154 | B2 | 1/2009 | Braunstein |
| 7,512,406 | B2 | 3/2009 | Dorfman |

(Continued)

OTHER PUBLICATIONS

Emory A. Fry, et al., "MASCAL: RFID Tracking of Patients, Staff and Equipment to Enhance Hospital Response to Mass Casualty Events", AMIA 2005 Symposium Proceedings Page, pp. 261-265.

*Primary Examiner* — Daryl Pope
(74) *Attorney, Agent, or Firm* — FSP LLC

(57) ABSTRACT

A system for tracking the locations of passengers on a vessel includes a portable tag configured to be assigned to a passenger, the tag encoded with a tag identifier. The system further includes a plurality of tag readers configured to be positioned at predetermined locations on a vessel, each tag reader configured to read the tag identifier of the tag when the tag reader receives a signal from the tag. A tracking component is configured to communicate with the tag readers, the tracking component configured to receive, from a detecting tag reader, an indication that the signal has been received from the tag, the tracking component configured to determine a detected location of the tag based at least in part on the predetermined location of the detecting tag reader. A notification component is configured to send towards a user device, a notification including the detected location, and a tag reader in the plurality of tag readers is configured with a first and second operating mode, the first operating mode is used when the vessel is at least a predetermined distance from land, and the second operating mode is used when the vessel is less than the predetermined distance from land.

27 Claims, 4 Drawing Sheets

(56) References Cited

U.S. PATENT DOCUMENTS

| | | | | |
|---|---|---|---|---|
| 7,536,188 | B1 | 5/2009 | Fegan et al. | |
| 2004/0021569 | A1 | 2/2004 | Lepkofker et al. | |
| 2005/0078006 | A1 | 4/2005 | Hutchins et al. | |
| 2006/0055552 | A1* | 3/2006 | Chung et al. | 340/686.1 |
| 2006/0267731 | A1 | 11/2006 | Chen | |
| 2007/0013519 | A1* | 1/2007 | Chung et al. | 340/572.1 |
| 2007/0100677 | A1 | 5/2007 | Boss et al. | |
| 2007/0159332 | A1 | 7/2007 | Koblasz | |
| 2008/0018472 | A1 | 1/2008 | Dasilva et al. | |
| 2008/0115541 | A1 | 5/2008 | Aldridge | |
| 2008/0126126 | A1 | 5/2008 | Ballai | |
| 2008/0266097 | A1 | 10/2008 | Lee | |
| 2009/0118002 | A1 | 5/2009 | Lyons et al. | |

* cited by examiner

TRACKING PASSENGERS ON CRUISE SHIPS

BACKGROUND

Modern cruise ships are often of great size, containing many rooms, facilities, entertainment areas, deck spaces, etc. which are open to passengers. Because these ships are so large, it may be easy for persons traveling in a group to lose track of one another. Once separated, passengers may need to search a large space in order to locate their companions. This may be inconvenient or impractical. In addition, often families with children may be traveling together on a cruise ship. In such cases, parents of the children may wish to remain informed of their children's whereabouts, while also allowing them to enjoy the ship's entertainments freely. However, it may be difficult for parents to locate their children once they are separated, as the common areas available on the ship may be extensive. Example embodiments of the present invention may address such concerns, for example, providing systems and processes for tracking individuals as they move about cruise ships, or other vessels or facilities.

SUMMARY

Example embodiments may provide a system for tracking the locations of passengers on a vessel, which may include a portable tag configured to be assigned to a passenger, the tag encoded with a tag identifier; a plurality of tag readers configured to be positioned at predetermined locations on a vessel, each tag reader configured to read the tag identifier of the tag when the tag reader receives a signal from the tag; a tracking component configured to communicate with the tag readers, the tracking component configured to receive, from a detecting tag reader, an indication that the signal has been received from the tag, the tracking component configured to determine a detected location of the tag based at least in part on the predetermined location of the detecting tag reader; and a notification component configured to send towards a user device, a notification including the detected location.

In some example embodiments, the tracking component may be further configured to determine the detected location based the detecting tag reader's power. And in some example embodiments, the tracking component may be further configured to determine the detected location based on a detected signal strength.

In some example embodiments, the tracking component may be further configured to determine the detected location based on a physical property of the vessel in an area near the detecting tag reader.

In some example embodiments, the notification may identify one of a room and a location on a deck.

In some example embodiments, the user device may be a wireless device. In example embodiments, the notification may be a text message. And in some example embodiments, the user device may be configured to display the detected location on a map of the vessel.

Some example embodiments may also include a user kiosk configured to communicate with the tracking system, the user kiosk configured to display the detected location, responsive to a user request.

In some example embodiments, the kiosk may be further configured to display a map of the vessel; and the kiosk may be further configured to display the detected location on the map.

In some example embodiments, the indication may include one of a time, a direction, a signal strength, and rate of change.

In some example embodiments, a tag reader in the plurality of tag readers may be configured with a first and second operating mode; the first operating mode may be used when the vessel is at least a predetermined distance from land; and the second operating mode may be used when the vessel is less than the predetermined distance from land.

In some example embodiments, the tag reader may be configured to operate at a first power level in the first operating mode and the tag reader is configured to operate at a second power level in the second operating mode.

In some example embodiments, the tag may include one of a wrist band, a room key, a beach tag, a smart card, a watch, and a wallet card.

In some example embodiments, the tag may be an RFID tag.

In some example embodiments, the tag may be configured to operate on a plurality of frequencies; a first tag reader in the plurality of tag readers may be configured to operate on a first frequency; and a second tag reader in the plurality of tag readers may be configured to operate on a second frequency.

In some example embodiments, the tag may be configured to operate on a plurality of frequencies; a first tag reader in the plurality of tag readers may be configured to operate on a first frequency; a second tag reader in the plurality of tag readers may be configured to operate on a second frequency; and a third tag reader in the plurality of tag readers may be configured to operate on a third frequency.

Some example embodiments may also include a customizable display located on the vessel configured to display a customized message based on the detected location.

Example embodiments may also provide a method for tracking the locations of passengers on a vessel, which may include assigning a portable tag to a passenger, the tag encoded with a tag identifier; positioning a plurality of tag readers at predetermined locations on a vessel, each tag reader configured to read the tag identifier of the tag when the tag reader receives a signal from the tag; detecting the tag with a first tag reader in the plurality of tag readers; identifying a detected location of the tag, responsive to detecting the tag with the first tag reader; and reporting the detected location of the tag to a user.

In some example embodiments, reporting the detected location may further include sending a text message towards one of a mobile telephone, a Personal Communication Device, and a computer.

Some example embodiments may also include charging a per message fee to a user.

Some example embodiments may also include receiving a notification rule; where reporting the detected location of the tag may be performed according to the notification rule.

Some example embodiments may also include receiving a group definition including a plurality of users; and reporting the detected location of the tag to each user in the plurality of users.

In some example embodiments, a second tag reader in the plurality of tag readers may be configured with a first and second operating mode. Such example embodiments may also include enabling the first operating mode when the vessel is at least a predetermined distance from land; and enabling the second operating mode when the vessel is less than the predetermined distance from land. And in some example embodiments, the first operating mode may be automatically enabled responsive to receiving a first Global Positioning System signal; and the second operating mode may be automatically enabled responsive to receiving a second Global Positioning System signal.

In addition, some example embodiments may also include allocating vessel staff based on the detected location. And some example embodiments may also include displaying a customized message based on the detected location.

BRIEF DESCRIPTION OF THE DRAWINGS

The present invention will be more readily understood from a detailed description of example embodiments taken in conjunction with the following figures.

DETAILED DESCRIPTION OF EXAMPLE EMBODIMENTS

Figure 1:
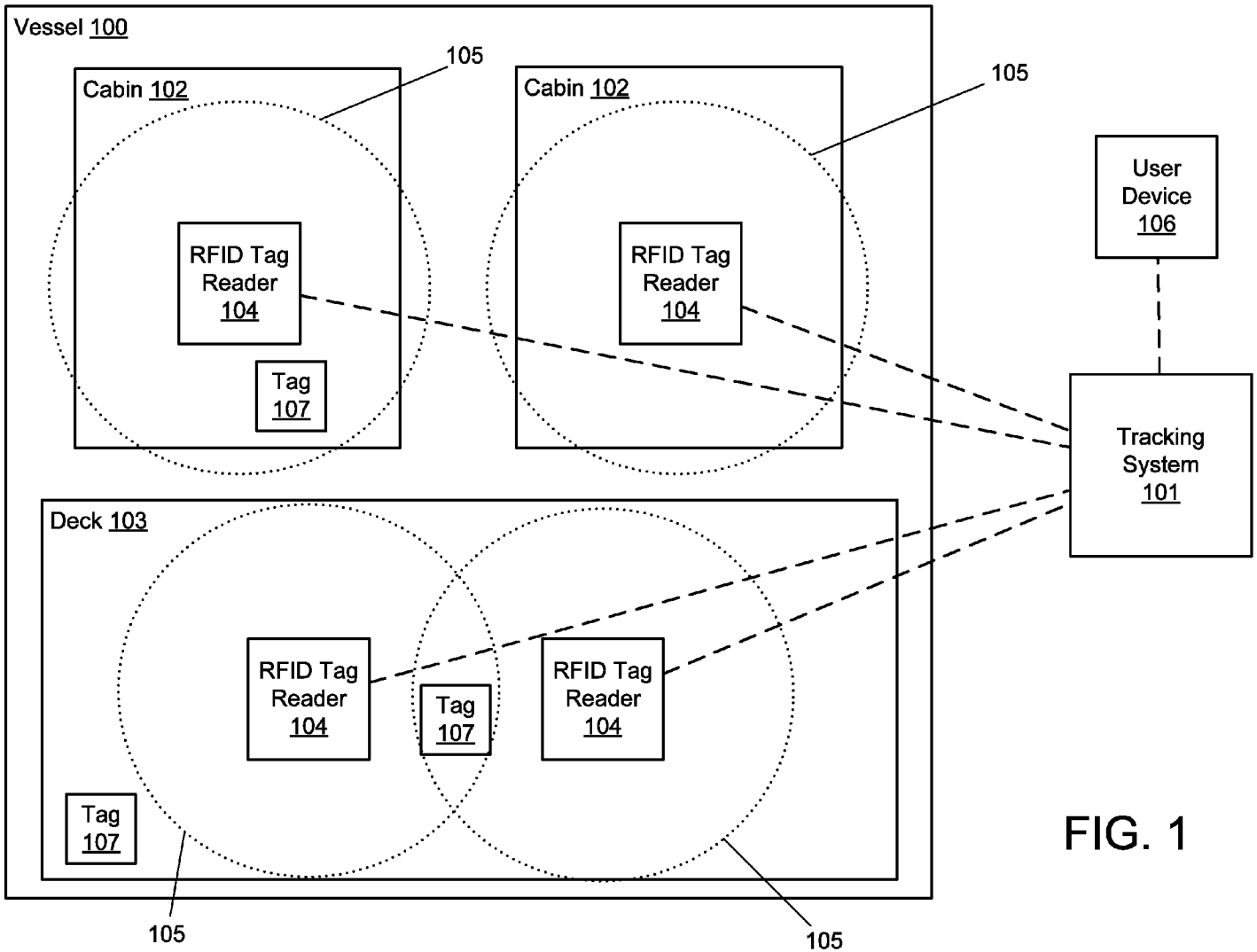
FIG. 1 illustrates an example system in accordance with an example embodiment of the present invention.

Example embodiments of the present invention may provide systems and procedures for tracking persons. In what follows, example embodiments are described with reference to the tracking of passengers on cruise ships. However, it is to be understood that the invention itself is more broadly applicable, and other example embodiments may be applied to the tracking of persons and objects generally, including, for example, on other kinds of vessels, in buildings, and on other properties.

Some example embodiments of the present invention may provide tracking systems for use on vessels or in other locations. Example systems may track the locations of persons on the vessel using RFID tags, or other similar devices. Such systems may allow for the tracking of persons carrying RFID tags. For example, passengers on a cruise ship may be issued RFID tags which may be used to facilitate tracking of that person's location while onboard the ship. Each RFID tag may be a radio transmitter which may be configured to communicate with RFID tag readers located throughout the vessel and designed to operate with the RFID tags. It is noted that, although the application may refer to RFID tags and RFID tag readers specifically, any other detection system may also be used. For example, some example embodiments may employ other wireless technologies, etc.

The RFID tags used may be of any suitable design. For instance, the RFID tags may include both an antenna and a storage device. Such tags may be configured to transmit the contents of the storage device to an RFID tag reader, using the antenna, when polled by the RFID tag reader.

The tags may be active, requiring a battery to function, or passive, drawing energy from an external source, e.g. the radio signal emitted by a tag reader, to provoke signal transmission. The tags may also be battery assisted passive tags, which make use of a battery for transmission of data, but are otherwise passive. As noted, the tags may contain a storage device storing an identification number, and/or possibly other information. The tags may be designed to transmit the stored information to a tag reader, when the tag is within range of the reader, and/or queried by any other applicable reader within range.

The RFID tags may operate using any reasonable frequency. In addition, the tags may operate on more than one frequency. For instance, the RFID tags may be dual or tri-band tags, which may be designed to operate in two or three different frequency ranges, depending on the reader with which it is in communication. For instance, such a tag may be constructed so as to communicate on any of the frequencies for which it is designed.

The RFID tags may take any form convenient for persons to carry while onboard the ship. For instance, the tags may be embedded in room/cabin keys or key cards, smart cards, other objects shaped like a standard credit card, wrist bands, watches, beach tags or other tags which may be affixed to clothing, etc. For example, persons boarding the ship may be permitted a tag of their choice, and tags may be created for different types of persons. For instance, wrist band tags may be issued to small children, while room key cards are issued to adults by default.

Example systems may include RFID tag readers capable of detecting and identifying the RFID tags carried by passengers on the ship. For instance, RFID tag readers, capable of interfacing with the RFID tags, may be placed throughout the ship, as illustrated in FIG. 1 As illustrated, RFID tag readers 104 may be located at predetermined positions throughout the vessel 100. For example, an RFID tag reader 104 may be placed in each room 102 on the ship 100, or selected rooms 102. Other RFID tag readers 104 may be located at selected positions on the deck 103 of the vessel 100, etc.

Each of the tag readers 104 may have an effective range 105, within which they may be capable of detecting and communicating with tags 107. For instance, each reader 104 may be configured to periodically transmit a polling signal. When a tag 107 is within range 105 of a reader 104, the tag 107 may receive the signal, and may respond by transmitting stored information to the reader 104. Each tag reader 104 may have the same effective range 105, or the tag readers may have different effective ranges. For example, in some embodiments the tag readers 104 may each be configured to have an effective range 105 based on the area they are intended to cover, e.g. a large room, a small room, a large portion of the deck, etc.

In some examples, the range 105 of the readers 104 may be individually tuned by adjusting their power level. For instance, a reader 104 in a large room 102 may be configured to operate at a somewhat higher power level, while a reader 104 within a smaller room 102 may operate at a lower power level. To provide such readers 104, the individual power levels of each reader 104 may be adjusted for the intended application. Some example embodiments may provide for a centralized system interface, which may be used to adjust individual power levels. In other embodiments, the power levels of various readers 104 may be configured by interfacing directly with the reader 104 itself.

In some examples, tag readers 104 with specific characteristics may be used for different locations or applications throughout the vessel 100. For instance, tag readers 104 operating on one frequency range may be used for locations inside the vessel 100 where, e.g., only a short range may be needed or desired, or where the frequency is less likely to interfere with devices commonly used inside, while readers 104 operating on a different range may be located on the deck 103 of the vessel 100, in order to provide a longer range. Deploying readers 104 in such a manner would, for example, allow greater tracking resolution inside the ship 100, where it my be desirable to identify an individual's location within single rooms 102, while providing longer range readers 104 on the deck 103, where it may be necessary only to locate persons to a sizable portion of the deck, e.g. a fore or aft portion of the deck 103. Further, in some example embodiments, three different frequency ranges may be used. In such embodiments, individual readers 104 may be configured to one or more of the frequency ranges depending on the environment in which the reader 104 is deployed. In such cases, the tags 107 used with the tag readers 104 may be tri-band tags 107, configured to communicate on any of the frequencies used by the readers 104. Any number and combination of frequencies, power levels, and other design characteristics may be employed.

In some example systems, the system of readers 104 may be configured with multiple operating modes. For example, one operating mode may allow for the use of higher power levels, or may allow readers 104 in a particular frequency range to be activated. Another operating mode may, however, allow only lower power levels, or may restrict the usable frequency ranges, etc. Such operating modes may be enabled manually, e.g. through a user interface, or may be automatically selected. For instance, the system may be connected to a source of vessel 100 position information, e.g. a Global Positioning System (GPS) or other navigation system, and may automatically activate one mode when the vessel 100 is within a predetermined distance from a shore line, e.g. 12 miles, and may use another operating mode when it is beyond such a distance. In such a way, example embodiments of the present invention may ensure that the system complies with national laws regarding radio use and interference, while also providing the best possible service when away from shore. Of course multiple operating modes may be defined for any possible use.

As explained above, the RFID tag readers 104 may be configured to communicate directly with the RFID tags 107. As noted, the readers 104 may transmit a signal on a frequency which the tags 107 are configured to use, e.g. periodically. When an RFID tag 107 is within range of the signal it may respond to the signal by transmitting data stored on the RFID tag 107. For instance, the tag 107 may transmit an ID number stored on the tag 107, which may uniquely identify the tag 107. The reader 104 may receive the ID number, or other transmitted data. In addition, the reader 104 may identify other information related to the communication. For example, the reader 104 may identify a time at which the communication occurred, a signal strength associated with the communication, the RFID tag's 107 direction of travel, etc. The readers 104 may include storage devices in which such information is stored. In addition, the readers 104 may include communications devices for communicating the gathered information to a tracking system 101. Such communications devices may be the same wireless communications devices used for communicating with the RFID tags 107, or may be another device, e.g. a device using a different wireless communication path, or a wired path, etc. In addition, the RFID tag readers 104 may be configured to relay information between themselves. For instance, the readers 104 may create a wireless network over which they 104 may communicate, and over which they 104 may forward communications to other devices in the system.

Figure 2:
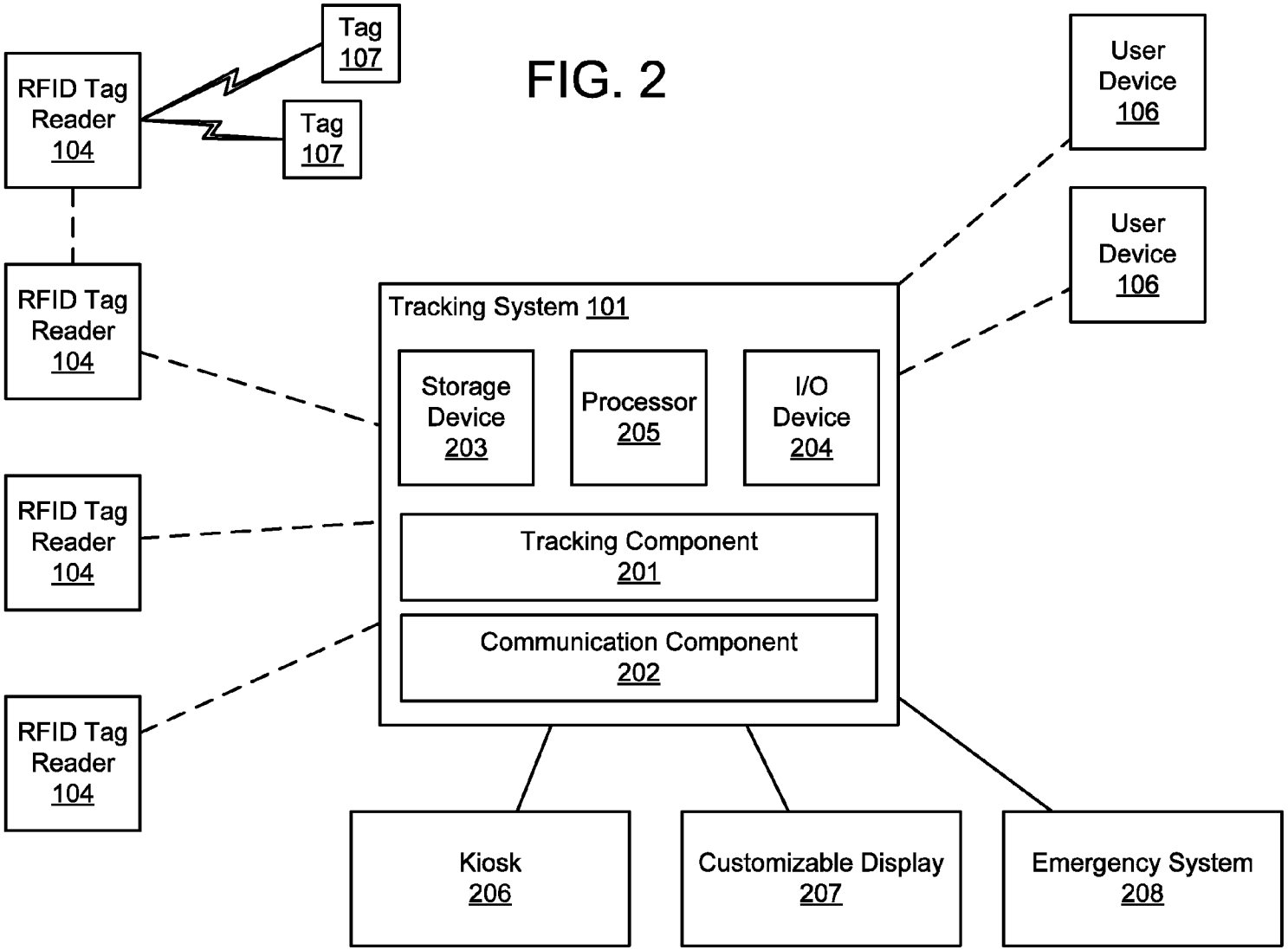
FIG. 2 illustrates an example system in accordance with an example embodiment of the present invention.

As explained, example systems may also include a tracking system 101, as illustrated in FIG. 2. In some examples, the tracking system 101 may include a server located on the vessel 100, which may be in communication with the RFID tag readers 104. For example, the tracking server 101 may include a tracking component 201 which may be configured to receive wireless communications from the RFID tag readers 104. Alternatively, the tracking component 201 may be in communication with the RFID tag readers 104 over a wire-based network, or other network. As illustrated, the RFID tag readers 104 may be in direct communication with the tracking system 101 or may relay messages through other readers 104 or relay devices.

The tracking system 101 may, for instance, include a processor 205, a storage device 203, and an I/O device 204. The tracking component 201 may receive from the RFID tag readers 104 the information that each reader 104 gathers. For instance, upon reading a tag 107, the readers 104 may transmit to the tracking system 101 the ID number read, the time at which it was read, the signal strength of the communication, a direction of travel, etc. The readers 104 may also transmit information identifying the reader 104 itself. The tracking system 101 may then store the received information, e.g. using the storage device 203, which may then be used to identify a location of the tag 107.

For instance, in one embodiment, each of the RFID tag readers 104 may be associated with a location identifier. The location identifier may either itself be, or may be related to, a description of the location in which the reader 104 is found. For instance, the tracking component 201 may store a name for each tag reader 104 indicating its location, e.g., "exercise room" or "foredeck," and may be able to access that name based on the information received from each card reader 104. Alternatively, the readers 104 themselves may store such names and may transmit those names to the tracking system 104.

In other examples, the tracking component 201 may also be equipped with a map of the monitored area, for instance, the passenger areas of a ship 100, or the entire ship 100, or may be configured with a coordinate system which may be used to encode spatial position throughout the ship 100. The tracking component 201 may also be configured with the locations of each of the RFID tag readers 104 and may be able to place the readers 104 on the map, or coordinate system, etc. In addition, the tracking component 201 may know the range of each RFID tag reader 104, and therefore, may be able to determine the approximate location of a detected tag 107, locating that tag 107 on the map or coordinate system.

In some embodiments, the tracking component 201 may be configured to gather and use additional information in identifying the location of a tag 107. For example, the tag readers 104 may be configured to record the signal strength with which they are able to communicate with a tag 107. For instance, when a tag reader 104 senses a tag 107, the tag reader 104 may record the signal strength. In such cases, the signal strength may be used to locate the tag 107. For example, if the tag is sensed concurrently by more than one reader 104, the tracking component 201 may be configured to determine the location of the tag 107 based on the relative signal strength with which the tag 107 was sensed by each reader 104. Such a situation may occur when the ranges 105 of two or more tag readers 104 overlap. For example, because signal strength may vary directly with the distance between a tag reader 104 and tag 107, the tracking component 201 may interpret the signal strengths to determine which tag reader 104 the tag 107 is closer to. Of course, because the tag readers 104 may operate with different power levels, etc., the tracking component 201 may not directly compare absolute measures of signal strength, but may account for the differing properties of the tag readers 104 when calculating location. Signal strength may be used in other situations as well. For instance, the tag readers 104 may continue to poll tags 107, even once they are identified, and may identify a tag's 107 signal strength during each poll. In such instances, the tracking component may use multiple signal strength readings, along with times at which such readings were collected, to identify a direction of travel of the tag 107. For instance, if the signal strength is growing weaker over time, the tag 107 may be moving away from the tag reader 104, etc. The tracking component may use any other relevant information to identify the location of a tag 107 as well. For instance, the tracking component may be configured with the physical layout of the vessel 100, and accordingly, may be aware of physical limitations on the movement of people throughout the vessel 100, e.g. aware that there is only one exit from a room; which may be used to further narrow the possible position of a tag 107.

Once the system has identified the location of a tag 107 it may notify users of the system with the location. For example, the system may include a communication component 202 configured to communicate the gathered information to users. The communication component 202 may be configured to communicate over any suitable communication path. For example, the communication component 202 may be capable of sending text (e.g. SMS) messages over a mobile telephone network. In such a case, the system may maintain a list of mobile telephone numbers which are to receive location messages for a particular RFID tag 107. The numbers may, for instance, be the mobile phone numbers of the parents of a child wearing an RFID tag 107, or may the mobile phone numbers of a group of friends, etc. In addition, the devices notified need not be mobile phones, but may be any user device 208, e.g. Personal Communication Systems (PCS), personal computers, etc., capable of receiving a message either over a wireless network, or over a physical network installed on the vessel 100. The communication component 202 may be configured to provide location information to the user devices 106 associated with a tag 107. For instance, when the tracking component 201 determines that the location of a tag has changed, the communications component 202 may transmit a message to each of the user devices 106 associated with the tag 107. Such a message may, e.g., indicate the name of the person carrying the tag 107, the new location of the person, and the time at which the person entered the new location, etc. In some embodiments, the message may include information which may be used to display a map of the vessel 100 on the user device 106, e.g. mobile phone, PCS, computer, etc., indicating the location of the tag 107, etc.

Such communications need not occur for every location update. Rather, as discussed more fully below, example systems may make location information available based on any number of rules or trigger conditions. Such rules and conditions may be configured either by the system administrator, or by users themselves. For instance, the system may be configured with a default notification rule, which may be personalized by the system's users. In addition, the system need not actively transmit location information to users. Rather, location information may be provided upon user request. For example, the communications component 202 may also be configured to receive remote demand messages from users of the tracking system requesting updates. For instance, the communications component 202 may receive a message from a mobile phone, PCS, personal computer, kiosk, etc., requesting an update on a passenger's location. The tracking system 101 may then identify the present location of that passenger, which may be forwarded to the requesting user. In such a case, the system 101 may ensure that the requesting user is permitted to receive the requested location. For instance, the system 101 may check to ensure that the requesting device 106 is on a list of registered devices 106, associated with the tag 107 being tracked.

In addition, the communications need not be restricted to reporting the location of a tag 107, or be directed to other users of the system. For instance, example systems may provide information to individual wearers of a tag 107. For example, a user may request information about the location of a particular room on the ship 100, and the system may respond by providing directions from the user's current location, as sensed by the system, to the requested location. In other examples, the system may transmit information to the wearer of a tag, notifying the wearer of events which may be beginning near the wearer's current location, or in other related locations.

Figure 4:
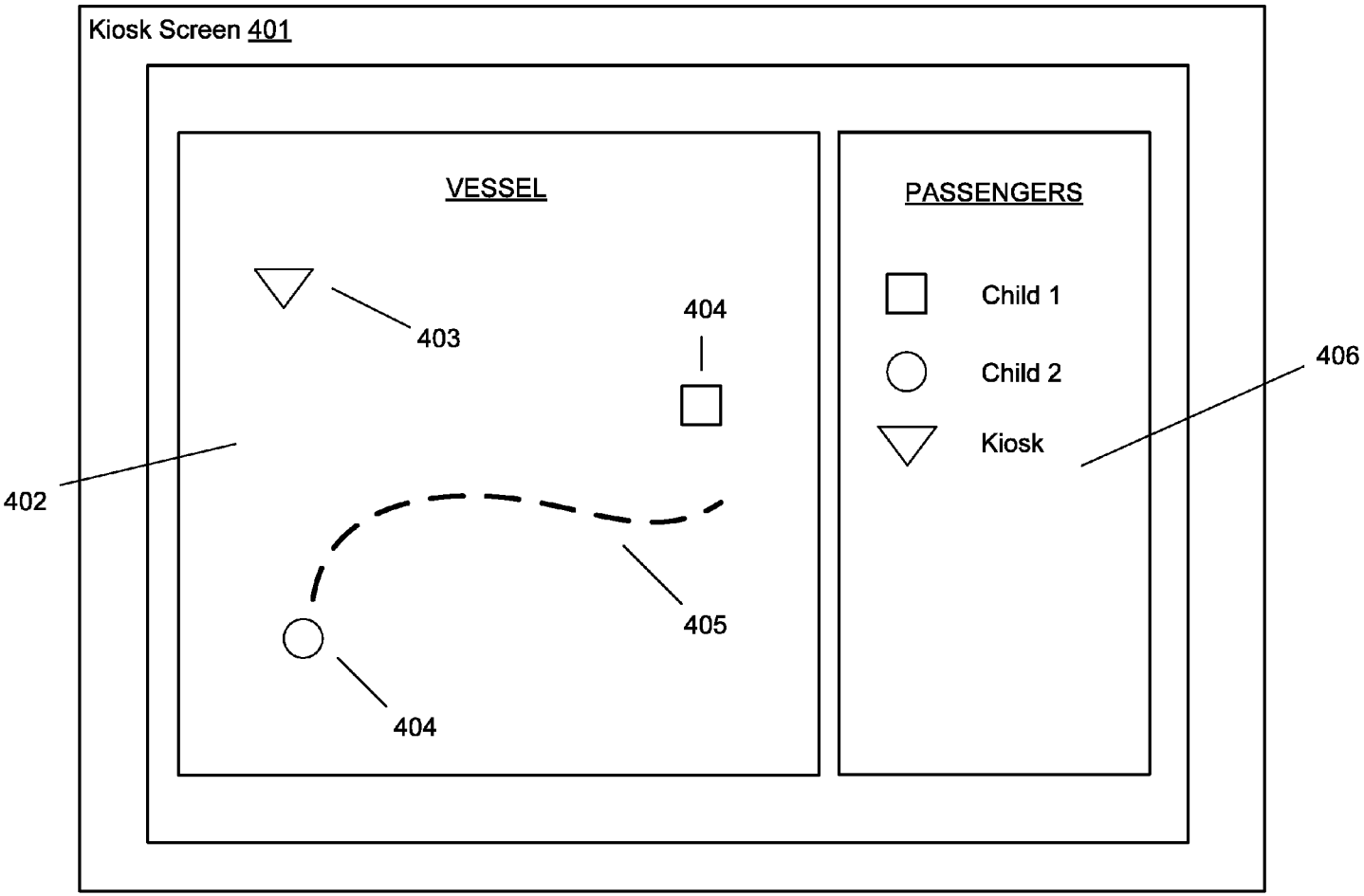
FIG. 4 illustrates an example kiosk screen in accordance with an example embodiment of the present invention.

The system may also include other components. For instance, the system may be equipped with kiosks 206 located in various locations around the vessel 100, accessible to users of the system. The kiosks 206 may include display devices and input devices which may allow users to learn the location of selected persons on the vessel 100. For instance, the kiosks 206 may display a map of the vessel 100, and may also display a marker indicating the current location of a person within the vessel 100. Such a kiosk 206 may be configured to display the locations of more than one person at the same time. For example, a simple kiosk 206 screen 401 is illustrated in FIG. 4. As shown, the kiosk 206 may display a map 402 of the vessel 100, and may also display information about persons whose locations are being tracked 406, such as the names of the persons, the symbols representing them on the map, and other information. On the map 402, the kiosk 206 may illustrate the locations 404 of persons being monitored, as well as the location 403 of the kiosk 206 for reference. The kiosk 206 may also illustrate historical, or other data, such as a path 405 showing the recent movement of a person being tracked. Any other information may be displayed on the kiosk 206 as well.

In addition, the kiosk 206 may be configured to provide location information only after successful authorization. For instance, the kiosk 206 may prompt each user for a user name and password, or other identifying information. Alternatively, the kiosk may attempt to detect an RFID tag 107 on the user. Should an RFID tag 107 be detected, the kiosk 206 may identify the user based on the tag 107 itself, and may authenticate the user to the system in that way. Thus in some embodiments, when a user with an RFID tag 107 approaches a kiosk 206, the kiosk 206 may respond by automatically displaying location information for each of the persons that user is authorized to view, e.g. illustrating the present location of each tag 107 on a map of the vessel 100. Such kiosks 206 may provide other services as well. For example, kiosks 206 may provide an interface using which users may configure the service, e.g. the notification rules, etc. In addition, kiosks 206 may allow users to leave messages for one another, etc.

Example system may also include other devices as well. For instance, the system may include displays 207 located throughout the vessel 100 which customize information for persons detected wearing tags 107 nearby, e.g. displaying customized advertisements, or statistics about the locations of passengers such as the number of persons in the gym, etc. Other systems may include links to the vessel's 100 emergency systems 208. For example, in the case of an emergency, the system may be configured to provide a display to the crew indicating the locations of all persons on the ship.

In other example embodiments, the RFID tag readers 104 may operate self-sufficiently. That is, some or all of the tag readers 104 may be equipped with a communications component capable of communicating directly with users. In such configurations, each tag reader 104 may be configured with a list of tags 107 and may associate the listed tags 107 with user devices having access to location information as to each tag 107. For instance, the tag readers 104 may have a list of tags 107 which contains a tag ID number. Associated with that ID number may be one or more mobile phone numbers, IP addresses, etc. When a tag reader 104 senses a tag 107 with a listed ID number come into its range 105, the tag reader 104 may use the communications component to send a message to the associated mobile phone, or other device, indicating the location of the tag 107.

In still other embodiments, the tags 107 themselves may carry reporting instructions. For instance, each tag 107 may store information identifying a device 106 to which location information should be reported, e.g. a mobile phone number, IP address, PCS, etc. In addition, the tag 107 may also encode other parameters, or conditions, instructing the system how to report location information. When a reader 104 senses a tag, in such an embodiment, it may read both the identifier and the additional information. It 104 may then report the location of the tag 107 directly to the identified device 106 according to the instructions, or it 104 may report the sensed information to a tracking system 101 which may function to report the information according to the instructions encoded on the tag 107.

As noted above, example systems may be configured to act based on configurable parameters or conditions. For instance, in examples including a tracking system 101, the tracking system 101 may be configured to operate differently depending on any number of configurable parameters. For instance, the tracking system may be configured to report the location of a tag 107 only during the day; or may be configured to report the location to a first device 106 during the day and a second device 106 at night. Alternatively, the tracking system 101 may be configured to report only certain locations, such a when a tag 107 enters a swimming pool area, or certain areas of entertainment, etc. Alternatively, the tracking system 101 may be configured to report the location of a tag 107 only if the location is a specified distance from another tag 107. Such parameters may be configured directly by the users. For example, the vessel 100 may include a number of configuration terminals which may accept user configuration information, such as the kiosks 206 described above. Alternatively, the system may make available a web page or other interface which may be accessed by users. Additionally, the communications devices 106 used for reporting may also be used to configure the tracking system 101. For instance, users may send SMS messages to the tracking system 101 requesting configuration settings or changes. In such examples, the tracking system 101 may store the configuration information, which may override default system behaviors.

In some example embodiments, such configurations may include user group definitions. For example, users may be able to identify a group of individuals, and tags 107 associated with the individuals, that are to have access to the locations of the other individuals. For instance, a family may identify itself to the system as a group, which may then provide location services to each member of the family as to all other members of the family. Individuals may belong to more than one group. For instance, an individual may belong to both a family group and a group of friends. In such cases, the individual would have access to the location information of each person in the two groups, and the others in each group would have access to the individual's location information as well. Although, an arbitrary member of the family group would not necessarily have access to location information for others in the friend group, etc. Users may be able to create and define groups, and configure the groups to which they belong.

Figure 3:
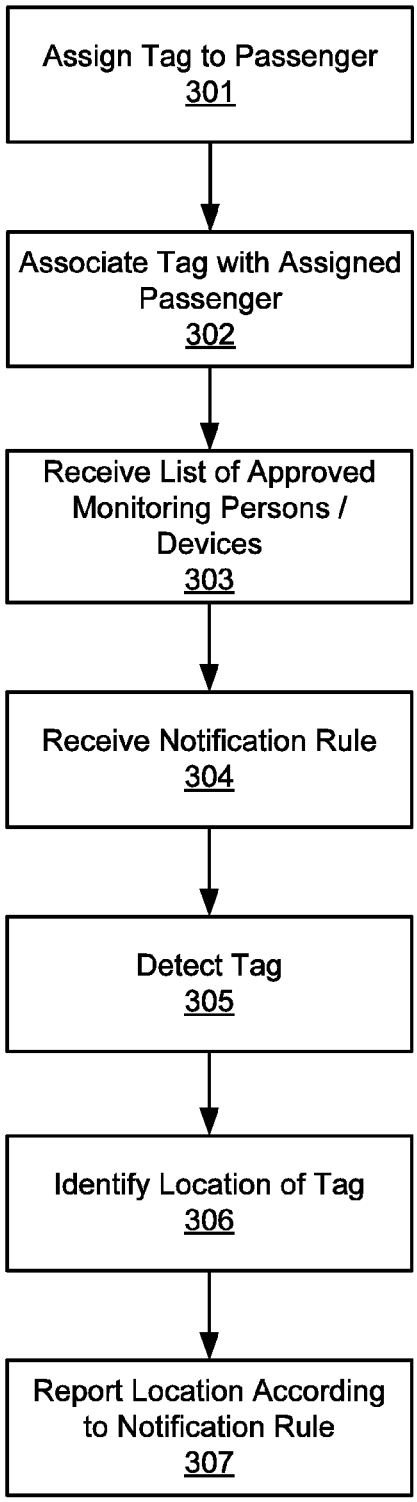
FIG. 3 illustrates an example procedure in accordance with an example embodiment of the present invention.

Some example embodiments may provide procedures for the tracking of passengers, e.g., on cruise ships 100. As illustrated in FIG. 3, such an example embodiment may begin when passengers board a ship 100. At 301, each passenger may be issued an RFID tag 107, which may enable tracking of the individual during that person's stay on the ship. The RFID tag 107 may take a form convenient for the person boarding the ship 100. For instance, the tags 107, as noted above, may be embedded in room/cabin keys or key cards, other objects shaped like a standard credit card, wrist bands, watches, beach tags or other tags which may be affixed to clothing, etc.

Once assigned, a tracking system 101 may be configured with information relating to the assigned tags 107. For example, at 302, each tag may be associated with a user, e.g. a user name. In addition, at 303, each tag may be associated with a list of individuals permitted to access location information for the tag 107, configure the system as to the tag 107, and user devices 106 having such access. In addition, at 304, the system 101 may be configured with notification rules, defining how the system is to react to a change in the tag's 107 location, etc. In other embodiments, each tag 107 itself may be updated to store such information.

Tags 107 need not be issued to every person boarding the ship 100. For example, in some example embodiments, individuals may first need to enroll in a tracking program to obtain a tag 107. Such enrollment may be free, or may be made part of a fee-based service as explained more fully below. In addition, tags 107 may be issued at other times. For instance, in some methods, tags 107 may be issued to persons before boarding the ship 100, e.g. they may be issued by mail. Alternatively, they may be issued once on the ship 100, e.g. when a person chooses to enroll in a tracking program, or the tags 107 may be left in a person's room, etc.

Once a tag 107 is issued, the user may carry or wear the tag 107 while moving about the ship 100. During the course of moving about the ship 100, the wearer may move in and out of range of various tag readers 104, which may be distributed about the ship 100 as described above. When the wearer of a tag 107 moves into range of a tag reader 104, the tag reader 104 may poll the tag 107, at 305. As part of the polling process, the tag 107 may transmit to the reader 104, information stored on the tag 107. As described above, the tag 107 may contain identifying information, such as an ID number or the wearer's name, and possibly other information as well. All such information may be transmitted to the tag reader 104, which may store or otherwise process the information. In addition, the tag reader 104 may collect other information, e.g. environmental information at the time of the poll. For instance, the tag reader 104 may identify a time at which the tag 107 was polled. In addition, the tag reader 104 may identify a signal strength experienced during the polling process.

Once the tag 107 has been polled, the reader 104 may process the information received. For instance, the reader 104 may report the information to a tracking system 101. As explained above, such reporting may take place using any suitable communication path. For instance, the reader 104 may wirelessly transmit the information to the tracking system 101, or may transmit the information over a wired network, etc. As noted above, in some embodiments, the reader 104 may itself process and report the location information. For instance, the reader 104 may transmit an SMS message to a mobile phone, PCS device, etc., indicating that a tag 107 was identified near the reader's 104 location.

In example embodiments, a tracking system 101 may receive the transmitted information from tag readers 104 throughout the vessel 100 and may record and store that information. In addition to receiving the information from the tag 107 itself, the tracking system 101 may also receive information specific to the tag reader 104. For instance, each tag reader 104 may be configured with an identifying ID number, or other piece of information, which it may transmit to the tracking system 101. This ID may be any kind of information which may be used to uniquely identify the reader 104. For instance, the ID may be an address used in the communication system between the tracking system 101 and the readers 104.

As explained above, the tracking system 101 may maintain a database associating each reader 104 with a location. Accordingly, in an example process, after receiving information from a reader 104, the tracking system 101 may, identify the location associated with that reader 101. For example, the tracking system 101 may look up the location of the reader 104 in the database. Alternatively, the ID of the reader itself may identify the location, for example, as location coordinates. The location identified by the tracking system 101 may be in the form of coordinates, in a coordinate system used through of the vessel, or may be in the form of a location description, etc. For instance, a reader's 104 location may be the name of a room, cabin, or other location, such as "gym," "video arcade," "aft dining room," or "starboard pool-deck."

The tracking system 101 may then assign a current location to the tag 107, at 306. For instance, the tracking system 101 may associate the location of a tag reader 104 with a tag 107 reported by the reader 104. Once associated, the tracking system 101 may consider this the location of the tag 107 until another tag reader 104 identifies the tag 107. Alternatively, the tag reader 104 in the location may periodically poll the tags 107 in the area, and if the tag 107 is not detected (and reported to the tracking system 101) the tracking system 101 may determine that the tag 107 location is no longer current.

The tracking system 101 may identify the location of a tag 107 using any suitable algorithm. For instance, the tracking system 101 may use information received from more than one reader 104 to fix the location of a tag 107, or may use information other than just the reader's 104 location to locate the tag 107. For instance, as described above, a tag 107 may be detected within the ranges of two or more readers 104 at a time. In such a case, the tracking system 101 use information received from each reader 104 to determine the location of the tag 107. In other embodiments, additional information may be used to identify a location, e.g. signal strength, physical characteristics of the location, direction of movement, time, characteristics of the tag reader 104, etc.

Once the location of a tag 107 has been identified, the tracking system 101 may, store the location information, and may determine whether the location of the tag 107 has changed. For example, if the tag 107 was most recently detected in the same location, the tracking system 101 may determine that the tag 107 is not moving. However, if the tag 107 was most recently detected in a different location, the system 101 may determine that the tag 107 has recently moved. In such cases, the new location may be stored, and identified as the current location of the tag 107.

The tracking system 101 may also report location information to users of the system, at 307. For example, the tracking system 101 may be configured with rules for each of the tags 107 in the system, which may instruct the tracking system 101 to perform one or more actions in given situations. For instance, the tracking system 101 may be configured to transmit a notification indicating a location of a tag 107, when the system 101 identifies movement of the tag 107. For example, if the tracking system 101 determines, based on a signal received from a tag reader 104, that a tag 107 has changed location, the tracking system 101 may determine that it is to take some action, e.g. notify a device 106 of the new location. As explained above, the system 101 may be configured with information identifying a device 106 to notify with information about the particular tag 107, e.g. a mobile phone number or IP address. The system may then send an indication to that device 106, e.g. using an SMS text message, indicating the new location of the tag 107, and possibly other information, e.g. the time at which the new location was detected, etc. Also as explained above, any kind of notification rules may be configured and the tracking system 101 need not always notify a device 106 for every location change, or even notify the same device 106. Rather, the tracking system 101 may be configured with other rules, e.g. rules which indicate that location messages are only to be sent when a tag 107 enters a certain area. Any useful rules may be configured, and the conditions for action need not be based on the particular tag 107. For instance, the tracking system 101 may be configured to send location messages only in response to a query, e.g. the user of a mobile phone, PCS, or other device, may send a text message to the tracking system 101 requesting location information about a tag 107. In such a case, the request need not even identify the tag 107 in question, as the tracking system 101 may have been configured to associate one or more tags 107 with the mobile phone, PCS, or other device. In which case, the system 101 may reply with location information for the associated tags 107. Also as noted above, the tracking system 101 may not respond unless the device 106 is authorized to receive information about the particular tag 107.

Example processes may also allow for user configuration of the tracking system 101. For example, an example process may begin when a user authenticates to the tracking system 101. This may be performed in any number of ways. For example, the user may log onto the system 101 with a username and password assigned to the user, using an interface provided by the system 101, e.g. a web page or a kiosk 206 interface screen. Alternatively, the user may configure the tracking system 101 from a pre-approved device 106, e.g. a mobile phone, PCS, or other device, which has been identified to the system 101. The user may also be identified by RFID tag 107. For instance, a user may approach a kiosk 206 which may have an RFID tag reader 104. If the user bears an RFID tag 107, the kiosk 206 may identify the user based on detection of the tag 107.

Once a user is authenticated, configuration commands may be input. For instance, the user may define rules under which the tracking system 101 is to send notifications for a given tag 107. Such rules may be set through an interface which may provide the user with a number of configuration choices, or may be set by a text message specifying a rule, etc. The configuration may apply to any tag 107 which the user is authorized to configure. For instance, the user may be authorized to manage five tags 107 assigned to members of the user's family. In such a case, the user may identify the tag 107 to be configured in any reasonable way, e.g. the system may identify the tags 107 to the user based on the names of the individuals to whom the tags 107 are assigned allowing the user to choose a tag 107 to configured, or the user may configure all manageable tags 107 at once.

The user may input other information as well. For instance, if the user is the bearer of a tag 107, or otherwise authorized to manage it, that user may configure the tracking system 101 to allow others to view location information associated with the tag 107. For example, the user may create a group of users which may be allowed to view the location of the tag 107. In some examples, this may simply involve adding the names of people to a list of authorized viewers, and the tracking system 101 may automatically relate the names with devices 106, tags 107, etc., which may be associated with the newly authorized viewer. In other examples, the user may identify an authorized viewer in other ways. For example, the user may input a mobile phone number, or PCS IP address, which may receive information relating to the tag 107 holder's location, etc.

Once the system receives configuration input from a user, the system may store that configuration, and associate the input information with a tag or tags to which it applies. For instance, the system may maintain a database of configuration information, which may be associated with individual tags. Once the information is loaded and stored, the system may begin using the new configuration information to direct the functioning of the tracking system.

Some example procedures may also include charging users of the system for use of the tracking service. For example, some example procedures may include charging a user a fee to begin service, for example, a per tag 107 fee, etc., which may be required before the tracking service may be used.

Other example embodiments may include charging users a per message fee. For example, in some example embodiments, tracking messages may be transmitted primarily by way of SMS text messages. In such embodiments, the provider of the ship's communication network may impose a per message charge, e.g. imposed on users through a telephone billing process. In such cases, the tracking system service provider may arrange to receive some or all of the per message fees charged. In other example embodiments, users may not be charged to use the tracking system. Rather, the tracking service may be provided free by the company running the cruise line. In some example embodiments the tracking service may be funded by advertising, for example, by advertisements transmitted to user devices 106, displayed on customizable displays 207, or otherwise presented to users of the service.

In addition, some example embodiments may include providing location information to crew members and taking action based on that information. For example, the tracking system 101 may provide aggregated information about the location of passengers. For instance, the tracking system 101 may calculate and provide the total number of persons detected in each area, whether the number of persons is increasing or decreasing in an area, historic information, the amount of time persons spend in an area on average, etc. In some examples, crew may be allocated to specific portions of the vessel 100 based on such information, or other actions taken. For instance, crew may be able to quickly determine that all passengers have arrived at their assigned "muster stations" for instructions prior to departing, or the location of certain planned activities may be changed, or special offers may be made to one or more passengers, etc.

It will be understood that the procedures described herein may be implemented using one or more computer programs or components. These components may be provided as a series of computer instructions on any conventional computer-readable medium, including RAM, ROM, flash memory, magnetic or optical disks, optical memory, or other storage media. The instructions may be configured to be executed by a processor, which when executing the series of computer instructions performs or facilitates the performance of all or part of the disclosed methods and procedures.

It will further be appreciated that the above-described methods and procedures may be provided using the systems disclosed herein, or on other types of systems. The methods and procedures, unless expressly limited, are not intended to be read to require particular actors or systems performing particular elements of the methods.

It will also be appreciated that the system components discussed herein may be provided as hardware, firmware, software or any combination thereof. If provided as software, such software may be stored in memory, for example in RAM, ROM, flash or other non-volatile memory, etc., or may be stored on another machine readable medium, such as magnetic or optical media, etc. In addition such software may be preloaded, or may be acquired and stored during functioning of a system.

In the preceding specification, the present invention has been described with reference to specific example embodiments thereof. It will, however, be evident that various modifications and changes may be made thereunto without departing from the broader spirit and scope of the present invention. The description and drawings are accordingly to be regarded in an illustrative rather than restrictive sense.

The invention claimed is:

1. A system for tracking the locations of passengers on a vessel comprising:

a portable tag configured to be assigned to a passenger, the tag encoded with a tag identifier;

a plurality of tag readers configured to be positioned at predetermined locations on a vessel, each tag reader configured to read the tag identifier of the tag when the tag reader receives a signal from the tag;

a tracking component configured to communicate with the tag readers, the tracking component configured to receive, from a detecting tag reader, an indication that the signal has been received from the tag, the tracking component configured to determine a detected location of the tag based at least in part on the predetermined location of the detecting tag reader;

a notification component configured to send towards a user device, a notification including the detected location;

a tag reader in the plurality of tag readers is configured with a first and second operating mode;

the first operating mode is used when the vessel is at least a predetermined distance from land; and the second operating mode is used when the vessel is less than the predetermined distance from land.

2. The system of claim 1 wherein:

the tracking component is further configured to determine the detected location based on the detecting tag reader's power.

3. The system of claim 1 wherein:

the tracking component is further configured to determine the detected location based on a detected signal strength.

4. The system of claim 2 wherein:

the tracking component is further configured to determine the detected location based on a physical property of the vessel in an area near the detecting tag reader.

5. The system of claim 1, wherein the notification identities one of a room and a location on a deck.

6. The system of claim 1, wherein the user device is a wireless device.

7. The system of claim 6, wherein the notification is a text message.

8. The system of claim 6 wherein:

the user device is configured to display the detected location on a map of the vessel.

9. The system of claim 1, further comprising:

a user kiosk configured to communicate with the tracking system, the user kiosk configured to display the detected location, responsive to a user request.

10. The system of claim 9 wherein:

the kiosk is further configured to display a map of the vessel; and the kiosk is further configured to display the detected location on the map.

11. The system of claim 1, wherein the indication includes one of a time, a direction, a signal strength and rate of change.

12. The system of claim 1, wherein the tag reader is configured to operate at a first power level in the first operating mode and the tag reader is configured to operate at a second power level in the second operating mode.

13. The system of claim 1, wherein the tag includes one of a wrist band, a watch a room key, a beach tag, a smart card, and a wallet card.

14. The system of claim 1, wherein the tag is an RFID tag.

15. The system of claim 1 wherein:

the tag is configured to operate on a plurality of frequencies;

a first tag reader in the plurality of tag readers is configured to operate on a first frequency; and a second tag reader in the plurality of tag readers is configured to operate on a second frequency.

16. The system of claim 1 wherein:

the tag is configured to operate on a plurality of frequencies;

a first of at least three tag readers in the plurality of tag readers is configured to operate on a first frequency;

a second of the at least three tag readers in the plurality of tag readers is configured to operate on a second frequency; and a third of the at least three tag readers in the plurality of tag readers is configured to operate on a third frequency.

17. The system of claim 1 further comprising:

a customizable display located on the vessel configured to display a customized message based on the detected location.

18. A method for tracking the locations of passengers on a vessel, comprising:

assigning a portable tag to a passenger, the tag encoded with a tag identifier;

positioning a plurality of tag readers at predetermined locations on a vessel, each tag reader configured to read the tag identifier of the tag when the tag reader receives a signal from the tag;

detecting the tag with a first tag reader in the plurality of tag readers;

identifying a detected location of the tag, responsive to detecting the tag with the first tag reader;

reporting the detected location of the tag to a user;

wherein at least one of the plurality of tag readers is configured with a first and second operating mode, the first operating mode enabled when the vessel is at least a predetermined distance from land; and the second operating mode enabled when the vessel is less than the predetermined distance from land.

19. The method of claim 18, wherein:

reporting the detected location further comprises sending a text message towards one of a mobile telephone, a Personal Communication Device and a computer.

20. The method of claim 19, further comprising:

charging a per message fee to the user.

21. The method of claim 18, further comprising:

receiving a notification rule;

wherein reporting the detected location of the tag is performed according to the notification rule.

22. The method of claim 18, further comprising:

receiving a group definition including a plurality of users; and reporting the detected location of the tag to each user in the plurality of users.

23. The method of claim 18, wherein:

the first operating mode is automatically enabled responsive to receiving a first Global Positioning System signal; and the second operating mode is automatically enabled responsive to receiving a second Global Positioning System signal.

24. The method of claim 18, further comprising:

allocating vessel staff based on the detected location.

25. The method of claim 18, further comprising:

displaying a customized message based on the detected location.

26. A method for tracking the locations of passengers on a vessel, comprising:

assigning a portable tag to a passenger, the tag encoded with a tag identifier;

positioning a plurality of tag readers at predetermined locations on a vessel, each tag reader configured to read the tag identifier of the tag when the tag reader receives a signal from the tag;

detecting the tag with a first tag reader in the plurality of tag readers;

identifying a detected location of the tag, responsive to detecting the tag with the first tag reader;

reporting the detected location of the tag to a user;

reporting the detected location further comprises sending a text message towards one of a mobile telephone, a Personal Communication Device and a computer; and charging a per message fee to the user.

27. The method of claim 26, further comprising:

receiving a group definition including a plurality of users; and reporting the detected location of the tag to each user in the plurality of users.

* * * * *